US006397538B1

(12) United States Patent
Phillips

(10) Patent No.: US 6,397,538 B1
(45) Date of Patent: Jun. 4, 2002

(54) FOUNDATION CORNER SAVER

(76) Inventor: A. Dale Phillips, 21950 Meadowhill Dr., #4, Spring, TX (US) 77388

( * ) Notice: Subject to any disclaimer, the term of this patent is extended or adjusted under 35 U.S.C. 154(b) by 0 days.

(21) Appl. No.: 09/668,887

(22) Filed: Sep. 25, 2000

(51) Int. Cl.[7] ..... E02D 27/00
(52) U.S. Cl. ..... 52/294; 52/408; 25/131
(58) Field of Search ..... 52/294, 295, 293.3, 52/102, 169.7; 249/34, 14

(56) References Cited

U.S. PATENT DOCUMENTS 2,298,837 A * 10/1942 Oswald ..... 25/131
6,122,874 A * 9/2000 Smerilli ..... 52/408

* cited by examiner

*Primary Examiner*—Carl D. Friedman
*Assistant Examiner*—Steve M Varner
(74) *Attorney, Agent, or Firm*—Bracewell & Patterson, L.L.P.

(57) ABSTRACT

A corner saving device reduces cracking of foundation corners of masonry veneer buildings. The corner saver has an L-shaped plate that has legs extending from each other at a 90° angle. The plate is formed of material that does not bond to masonry mortar. An anchor extends from each of the legs downward. Fasteners secure the plate to a lower side of the corner of two foundation frame spacer boards. After the concrete has set and the foundation frame removed, the plate will remain in place, flush with the ledge located at the periphery of the foundation.

17 Claims, 3 Drawing Sheets

FOUNDATION CORNER SAVER

FIELD OF THE INVENTION

This invention relates in general to an attachment for a foundation frame for pouring a concrete foundation, and particularly to a plate that locates at corners to reduce a tendency for corner cracking.

BACKGROUND OF THE INVENTION

Many residential homes being built currently have concrete slab foundations, a wooden frame, and a masonry veneer, such as brick. Vertical sideboards are set up at the periphery of the foundation. Spacer boards extend from the upper edges of the vertical sideboards inward. While pouring the foundation, concrete will be poured within the frame flush with the spacer boards and the upper edges of the sideboards. After the concrete has set sufficiently, the sideboards and spacer boards are pulled away from the foundation. Removing the spacer boards leaves a ledge at the edge of the foundation for receiving the base of the masonry veneer.

The wooden frame of the house will be built on the foundation starting just inward of the ledge created by the spacer boards. To install the brick veneer, a mason will build a veneer wall from the ledge upward. It is a good practice to place a plastic film over the ledge to prevent bonding of the mortar to the ledge. The mason will tie the veneer wall to the wooden frame in a conventional manner.

After construction, the foundation will expand and contract due to temperature changes. The foundation may also move due to swelling of the soil, particularly if clay is present. The expansion and contraction of a brick veneer wall is not the same as that of the foundation because of different coefficients of expansion. If the mortar has been allowed to bond to the ledge, substantial pressures will be created, particularly at the corners. This results in cracking at the corners. A cracked foundation corner is unsightly and expensive to repair.

SUMMARY OF THE INVENTION

In this invention, a plate is positioned at each of the corners of the foundation frame. The plate has first and second legs, each leg being of substantially the same width as one of the spacer boards. The plate is fastened to a lower side of two of the spacer boards at the corner.

After the concrete has been poured and set, the operator removes the spacer boards and sideboards in a conventional manner. However, the operator leaves the plate in place it at the corner, flush with the ledge. The plate has an upper surface that is formed of a material that will not bond to the mortar. Consequently, bonding of the mortar of the veneer wall to the foundation does not occur at the corner. This reduces the tendency for the corners to crack.

DESCRIPTION OF THE PREFERRED EMBODIMENT

Figure 1:
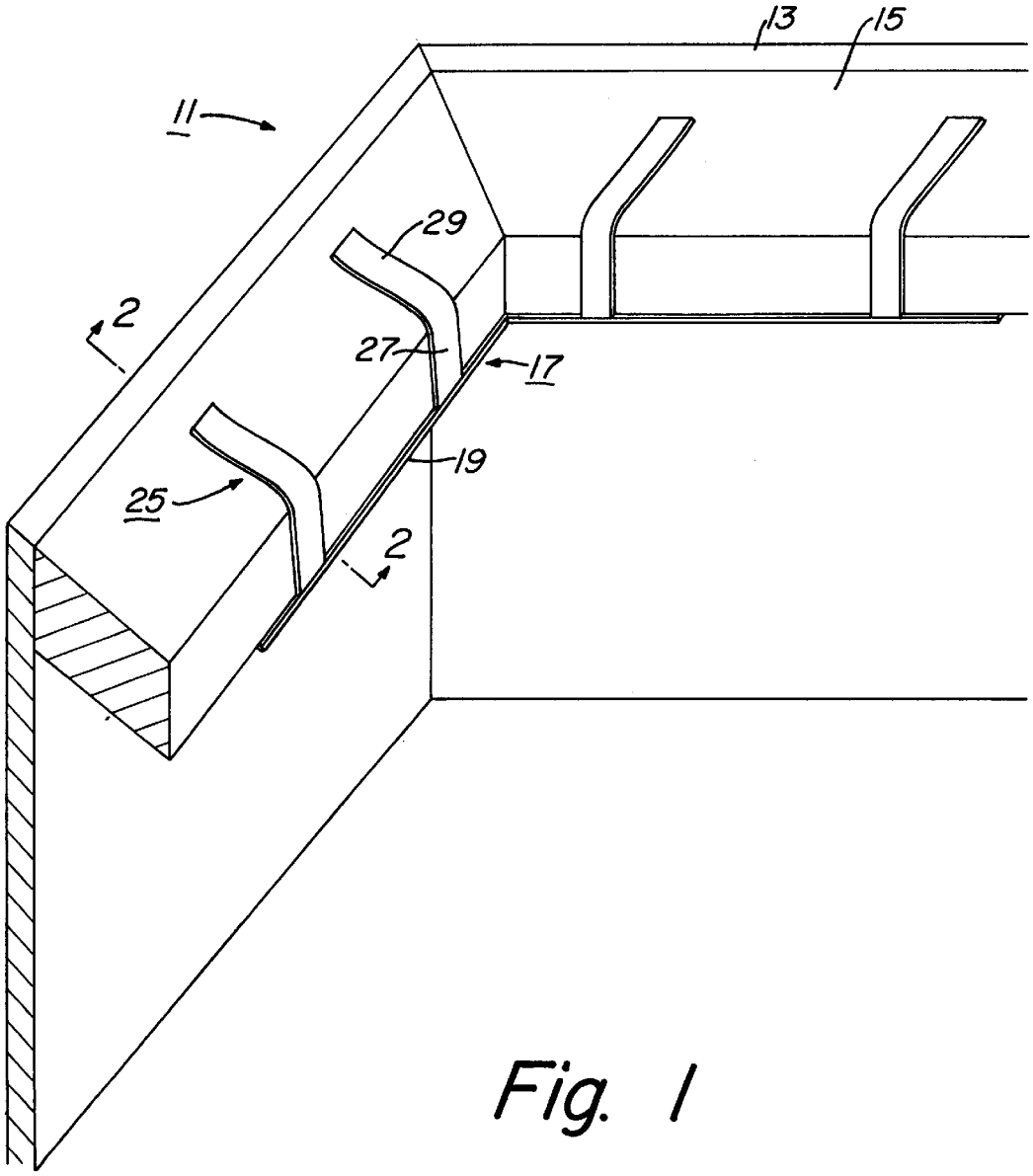
FIG. 1 is a perspective view of a foundation corner saver constructed in accordance with this invention, shown attached to the underside of spacer oards of a foundation frame.

It is understood that the invention may be embodied in other specific forms by one of ordinary skill in the art without departing from its spirit or central characteristics. The present example and embodiment are thus to be considered as illustrative and not restrictive, and the invention is not intended to be limited to the details of the listed embodiment. Rather, the invention is defined by the claims, and as broadly as prior inventions in the art will permit.

As shown in FIGS. 1, 2, 3, 4 and 5, a frame 11 for a residential concrete foundation will be constructed by securing sideboards 13 perpendicular to the ground in the shape of the foundation to be poured. To the top of the sideboard 13, spacer boards 15 will be attached to the inside of the sideboards 13 parallel to the ground and perpendicular to the sideboards 13.

A corner saver 17 is mounted to the spacer boards 15 at each corner of frame 11. Comer saver 17 includes a flat L-shaped plate 19, having two legs 21, 23 extending at right angles to each other. Each leg 21, 23 has the same width as one of the spacer boards 15 and fits flush against an underside of one of the spacer boards 15.

Releasable fasteners are employed to releasably secured corner saver 17 to spacer boards 15. Preferably, the fasteners comprise clips 25 attached to the top of the corner saver 17 along the inside edges of the legs 21, 23. Each clip 25 has a first portion 27 that extends upward the thickness of one of the spacer boards 15 and a second portion 29 that extends outward. This allows the clips 25 to slide over the inward edge of spacer boards 15. The clips 25 secure the corner saver 17 to the underside of the spacer boards 15 in the desired corner, as shown in FIG. 1.

Figure 3:
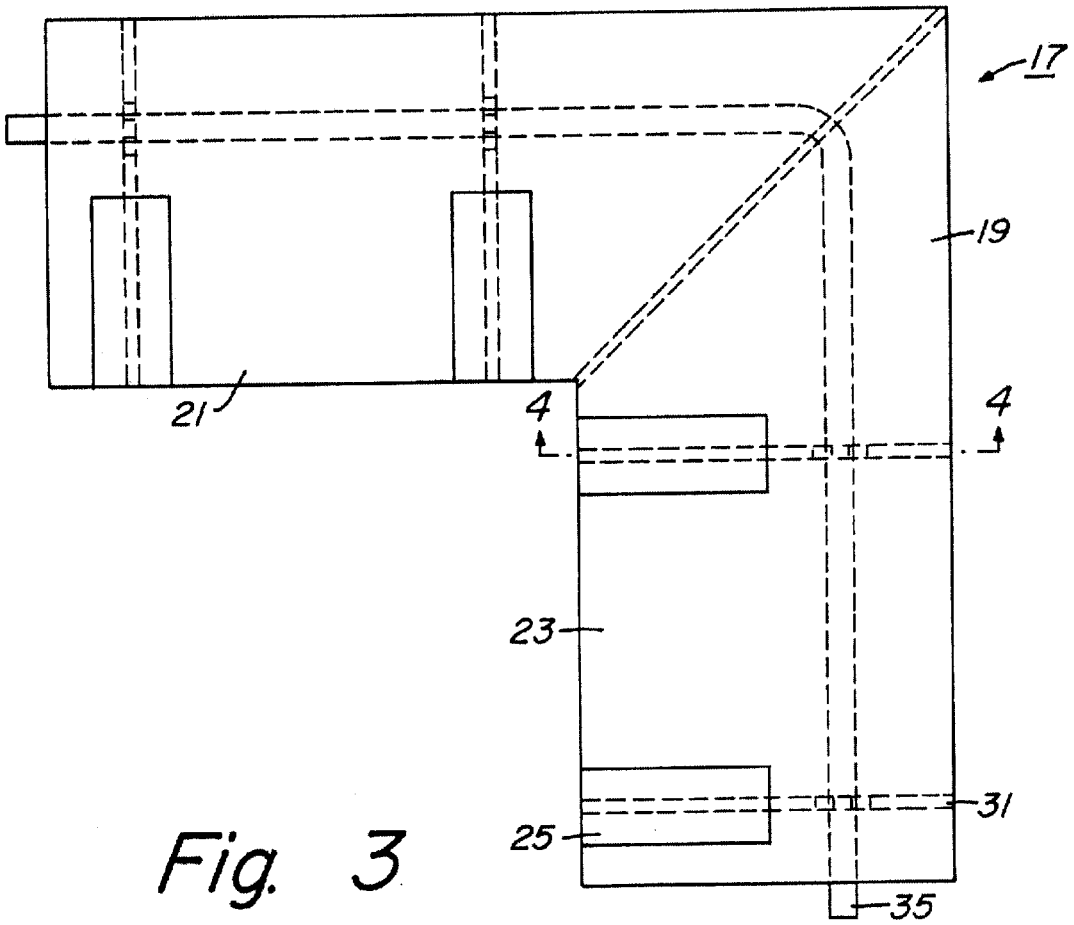
FIG. 3 is a top perspective view of the foundation corner saver of FIG. 1.
Figure 4:
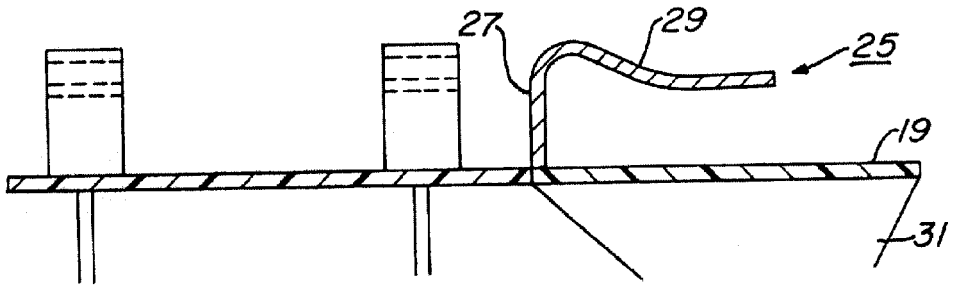
FIG. 4 is a sectional view of the foundation corner saver of FIG. 1, taken along the line 4—4 of FIG. 3.

Snap hangers 31 are attached to the underside of the corner saver 17. Five snap hangers 31 are positioned on each corner saver 17, each extending downward perpendicular to plate 19. Each snap hanger 31 has a slot 33 on its lower edge. A steel rebar member 35 having an L-shape configuration snaps into slots 33 in snap hangers 31, as shown in FIGS. 3 and 4. Snap hangers 31 and rebar member 35 serve as an anchor to secure plate 19 to the foundation. Other types of anchors may also be used, such as a barbed protuberance extending downward from plate 19. Corner saver 17 has at least an upper surface that will not bond to masonry mortar, and preferably is formed of plastic.

To pour a foundation, a frame 11 will be constructed by securing sideboards 13 perpendicular to the ground and then fastening spacer boards 15 to the top of the sideboards 13. The spacer boards 15 will attach to the inside of the sideboards 13 parallel to the ground and at a right angle to the sideboards 13. The spacer boards 15 will create a ledge 39 around the foundation 37 onto which the brick veneer walls of the structure to be built will rest.

Figure 2:
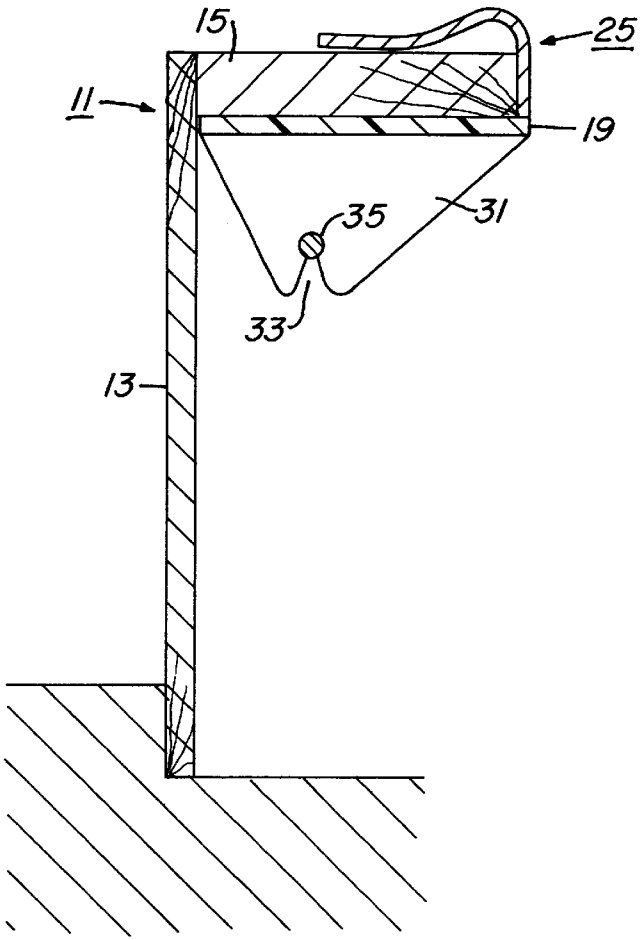
FIG. 2 is a sectional view of the foundation corner saver of FIG. 1, taken along the line 2—2 of FIG. 1.

Then the corner saver 17 is attached to the frame 11, with clips 25 facing up and the snap hangers 31 extending down. The worker slips the clips 25 over the inside edges of the spacer boards 15 until the first portion 27 of the clips 25 rests against the inside edge of the spacer board 15, as shown in FIG. 1. When in place, the plate 19 should extend underneath 20 the spacer board to the inside edge of the sideboard 13. The corner steel rebar member 35 snaps into slots 33 in snap hangers 31, as shown in FIGS. 2, 3 and 4.

Figure 5:
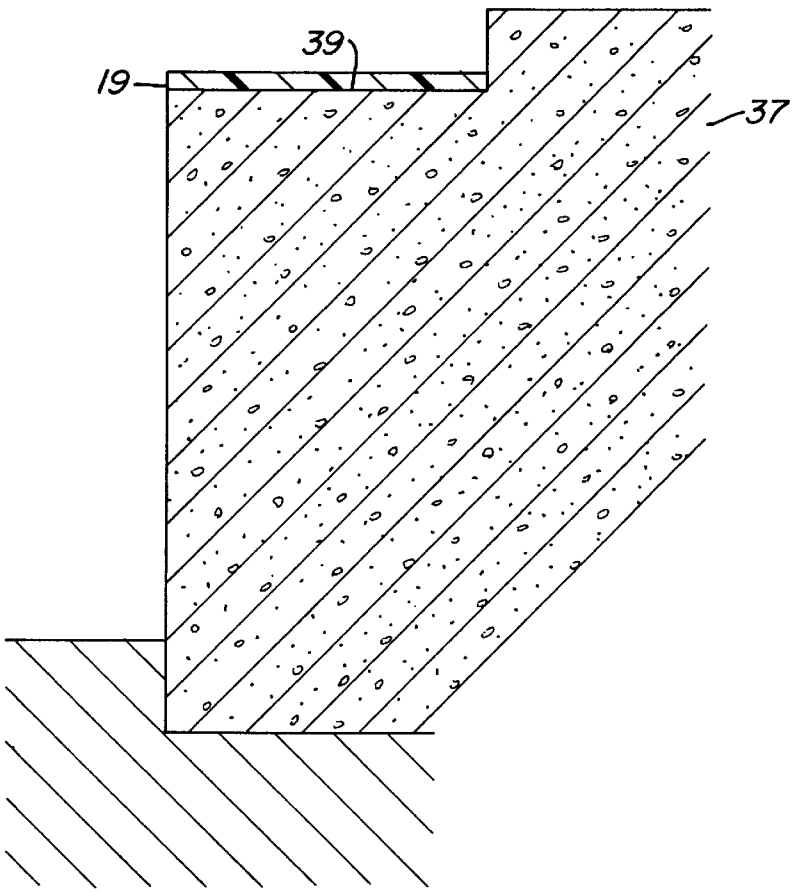
FIG. 5 is a side perspective view of a foundation corner saver without clips, showing a foundation with the frame removed.

Concrete is poured to the top edge of the spacer boards 15 to form the foundation 37. Rebar member 35 and snap hangers 31 will be embedded in the concrete. Frame 11 is removed from the cured concrete foundation 37 leaving corner saver 17. Clips 25 are snapped off of the corner saver 33 at the point of connection to plate 33 leaving only the L-shaped plate 33 on ledge 39 of foundation 37, as shown in FIG. 5. Plate 33 is flush with ledge 39.

Subsequently, after the structure is formed and insulated, brick layers will construct a brick veneer wall on ledge 39. A plastic film will be placed on ledge 39 to avoid mortar bonding with ledge 39. At the corners, corner saver 17 avoids bonding of the mortar with ledge 39. The mortar is placed on plate 33 at the corners. The brick veneer wall is tied into the frame of the structure.

After construction, foundation 37 will expand and contract due to temperature changes. The expansion and contraction of the brick veneer wall is not the same because of different coefficients of expansion. The corner saver 17 allows slight relative movement to occur at the corners between the brick veneer wall and foundation 37. This reduces the chances of cracking of corners of foundation 37 due to bonding of the mortar with foundation 37.

The invention has significant advantages. The corner saving device reduces the incidence of cracking of foundation corners. The device is simple and inexpensive.

While the invention has been shown in only one of its forms, it should be apparent to those skilled in the art that it is not so limited, but is susceptible to various changes without departing from the scope of the invention.

I claim:

1. In a concrete foundation frame having vertical sideboards, a horizontal spacer board extending from an upper edge of each of the sideboards to define an outer ledge around the foundation for receiving a masonry veneer, the sideboards and the spacer boards joining each other to form a corner of the foundation, the improvement comprising:

a plate having first and second legs, each leg being of substantially the same width as one of the spacer boards;

a fastener that secures the plate to a lower side of two of the spacer boards at the corner, with one of the legs located under one of the spacer boards and the other of the legs located under another of the spacer boards; and the fastener being releasable from the spacer boards to enable the spacer boards and sideboards to be removed from the foundation after the concrete has set, leaving the plate at the corner flush with the ledge to avoid bonding of the veneer with the foundation at the corner.

2. The frame according to claim 1, wherein the fastener comprises at least one clip secured to the plate, the clip having an upper portion that resiliently snaps over one of the spacer boards.

3. The frame according to claim 1, further comprising an anchor depending from the plate and adapted to be embedded in the concrete to retain the plate with the foundation.

4. The frame according to claim 1, further comprising:

a hanger depending from each of the legs; and a steel rod secured to the hangers and extending generally parallel to the plate to form with the hangers an anchor for embedding in the concrete.

5. The frame according to claim 1, further comprising:

a pair of hangers depending from each of the legs, each having a slot on a lower edge; and a steel rod secured to the hangers in the slots and extending generally horizontal to form with the hangers an anchor for embedding in the concrete.

6. The frame according to claim 1, wherein the plate is located in a single plane, and the legs extend perpendicular to each other.

7. The frame according to claim 1, wherein the plate is formed of a material that will not bond with mortar of the veneer.

8. The frame according to claim 1, wherein the fastener comprises at least one clip having a vertical portion secured to an inner edge of one of the legs and a horizontal portion that extends over the place and resiliently snaps over one of the spacer boards; and wherein the clips are releasable from the plate by shearing the vertical portion of each of the clips from the plate.

9. An apparatus for mounting to a concrete foundation frame for reducing cracking of concrete foundation corners of masonry veneer buildings, the frame having, vertical sideboards and a horizontal spacer board extending from an upper edge of each of the sideboards, the apparatus comprising:

a generally L-shaped plate formed in a single plane and having first and second legs extending from each other at a 90 degree angle, the plate having an upper surface formed of a material that does not bond to masonry mortar;

an anchor depending from each of the legs for being embedded in concrete to permanently secure the plate to the foundation;

a plurality of fasteners for securing the plate to a lower side of a corner of two of the spacer boards of the foundation frame; and the fasteners being releasable from the spacer boards to enable the spacer boards and the sideboards of the foundation frame to be removed from the foundation after the concrete has set, leaving the plate at the corner flush with the ledge to avoid bonding of the mortar with the foundation at the corner.

10. The apparatus according to claim 9, wherein each of the fasteners comprises a clip secured to the plate, the clip having an upper portion that overlies and is spaced from the plate for resiliently snapping over one of the spacer boards.

11. The frame according to claim 10, wherein the anchor comprises:

a hanger depending from each of the legs; and a steel rod secured to the hangers and extending generally parallel to the plate.

12. The frame according to claim 10, wherein the anchor comprises:

a pair of hangers depending from each of the legs, each having a slot on a lower edge; and a steel rod secured to the hangers in the slots and extending generally parallel to the plate.

13. The frame according to claim 1, wherein the each of the fasteners comprises a clip having a vertical portion secured to an inner edge of one of the legs and a horizontal portion that extends over the place and for resiliently snapping over one of the spacer boards; and wherein the clips are releasable from the plate by shearing the vertical portion of each of the clips from the plate.

14. A method for forming a forming a concrete foundation, comprising:

(a) forming a foundation frame with vertical sideboards and horizontal spacer boards extending inward from upper edges of the sideboards, the sideboards and the spacer boards joining each other to form at least one corner of the foundation;

(b) fastening a plate to a lower side of each of the spacer boards at the corner, the plate having first and second legs of substantially the same width as the spacer boards, the plate having an upper surface that is of a material that does not bond to masonry veneer;

(c) pouring concrete within the foundation frame to form a concrete foundation; and (d) removing the side boards and spacer boards from the foundation after the concrete has set, defining a ledge in the space previously occupied by the spacer boards, and leaving the plate at the corner flush with the ledge, to avoid bonding of the masonry veneer with the foundation at the corner.

15. The method according to claim 14, wherein step (b) comprises providing the plate with clips and sliding the clips over inner edges of the spacer boards.

16. The method according to claim 14, wherein step (b) further comprises providing the plate with anchors depending therefrom, and embedding the anchors in the concrete to retain the plate with the foundation.

17. The method according to claim 14, wherein:

step (b) comprises providing the plate with clips and sliding the clips over inner edges of the spacer boards; and step (d) further comprises:

removing the clips from the plate after the concrete has set.

* * * * *